US007414593B2

(12) United States Patent
Williams et al.

(10) Patent No.: US 7,414,593 B2
(45) Date of Patent: Aug. 19, 2008

(54) THERMOFORMED FREQUENCY SELECTIVE SURFACE

(75) Inventors: Victor G. Williams, Washington Township, OH (US); Andrew B. MacFarland, Beavercreek, OH (US); Ethan C. Saladin, Centerville, OH (US); Jay C. Marcum, Beavercreek, OH (US)

(73) Assignee: Alliant Techsystems Inc., Minneapolis, MN (US)

( * ) Notice: Subject to any disclaimer, the term of this patent is extended or adjusted under 35 U.S.C. 154(b) by 433 days.

(21) Appl. No.: 11/362,442

(22) Filed: Feb. 24, 2006

(65) Prior Publication Data

US 2007/0200787 A1 Aug. 30, 2007

(51) Int. Cl.
*H01Q 15/02* (2006.01)

(52) U.S. Cl. ..... 343/909; 343/700 MS

(58) Field of Classification Search ..... 343/909, 343/700 MS, 872; 29/600
See application file for complete search history.

(56) References Cited

U.S. PATENT DOCUMENTS 5,861,860 A * 1/1999 Stanek et al. ..... 343/909
6,285,332 B1 * 9/2001 Chandler ..... 343/756
2005/0237267 A1 * 10/2005 Brown et al. ..... 343/909

* cited by examiner

*Primary Examiner*—HoangAnh T Le
(74) *Attorney, Agent, or Firm*—Knobbe, Martens, Olson & Bear, LLP

(57) ABSTRACT

A three-dimensional FSS fabrication system is described. FSS elements are pre-mapped in two-dimensional form and constructed on a flat FSS panel that is then formed into a desired three-dimensional shape. The 2-D flat surface of the designed FSS is mapped into a desired three-dimensional curvature so that when formed from 2-D into the 3-D shape, the FSS elements are moved into a desired position and/or orientation. In one embodiment, the mapping from 2-D to 3-D is performed using the elastic properties of a desired substrate material. In one embodiment, one or more flat FSS panels are constructed on a formable or thermo-formable substrate. In one embodiment, the substrate includes a thermoplastic. In one embodiment, the substrate includes a thermoplastic material with fiber reinforcement. The FSS elements can be created by printing, deposition, photo-etching, etc. The flat FSS layers are thermoformed or chemically formed over a tool having the desired shape. In one embodiment, the FSS layers are formed to the shape of the tool by using vacuum techniques. In one embodiment, the FSS layers are formed to the shape of the tool by supporting the FSS layer between male and female tools.

30 Claims, 4 Drawing Sheets

THERMOFORMED FREQUENCY SELECTIVE SURFACE

BACKGROUND OF THE INVENTION

1. Field of the Invention

The invention relates to methods for thermoforming Frequency Selective Surfaces (FSS) for antennas, radomes and the like.

2. Description of the Related Art

Frequency selective surfaces (FSS) are useful in many radio-frequency and optical applications. Such applications include antennas, radomes, canopies, and other aircraft structures and the receiving surfaces of satellite dishes. A surface may be made frequency selective by forming a pattern on the surface, for example, by applying a patterned metal layer to the surface. The accuracy of the frequency selectivity of the surface depends on the precision of the pattern formed on the surface. Curvature in the surface complicates the pattern and makes fabrication difficult. Currently, there is no known method for patterning curved surfaces to achieve precise frequency selectivity in a cost effective manner.

SUMMARY

These and other problems are solved by using a three-dimensional FSS fabrication system. In the three-dimensional fabrication system, the element geometry and/or FSS grid geometry can be pre-mapped (or pre-distorted) in two-dimensional form prior to further shaping into a three-dimensional surface. In one embodiment, the FSS elements are pre-positioned to produce a desired element placement in the final shape. In one embodiment, mapping of the FSS from the two-dimensional geometry into the three-dimensional geometry is facilitated by using an elastic substrate, such as, for example, a thermoplastic substrate. Constructing the FSS elements on a relatively flat substrate and then forming the FSS and substrate into a desired three-dimensional shape is less expensive and more accurate than prior-art methods of constructing three-dimensional curved FSS structures.

In one embodiment, a substantially flat 2-D FSS structure is designed and constructed, and then the flat FSS structure is formed into a 3-D FSS structure. In one embodiment, the 2-D flat surface of the designed FSS is mapped into a desired three-dimensional curvature. The mapping can be done analytically (e.g., by mathematical analysis, numerical analysis, etc.). In one embodiment, the mapping from 2-D to 3-D is analytically performed using the elastic properties of a desired substrate material and the physics of the forming technique employed. (The term substrate is used herein to refer to a carrier material provided to the FSS. The term substrate is used for purposes of explanation, and is not intended to be limiting. Thus, the substrate can be a substrate, a superstrate, and/or combinations of substrates and superstrates.) The mapping can also be done by conducting distortion testing based on physical measurements. Thus, for example, in one embodiment, physical testing is provided by defining locations (for instance, in the form of a grid of points) on a flat test sheet of material and then forming the flat sheet into the desired 3-D shape. In one embodiment, one or more FSS layers are provided to the flat test sheet before the test sheet is formed into the desired 3-D shape.

Once the mapping from 2-D to 3-D is determined (e.g., by calculation and/or testing) then the desired element locations on the 3-D FSS are then inversely mapped from the 3-D space back to the flat 2-D space. Thus, the 3-D to 2-D mapping is used to change the specification of the element locations, shapes and orientations on the flat FSS panel such that when the 2-D FSS panel is formed into the desired 3-D shape, the FSS elements on the 3-D shape will move to their desired positions. In one embodiment, the coordinate mappings between 2-D and 3-D are used to determine the position of one or more FSS elements on the flat 2-D FSS layer. In one embodiment, the coordinate mappings between 2-D and 3-D are used to determine the rotational orientation of one or more FSS elements on the flat FSS layer. In one embodiment, the coordinate mappings between 2-D and 3-D are used to determine the position and rotational orientation of one or more FSS elements on the flat FSS layer. The pre-thermoforming FSS geometry can also be determined experimentally by placing a uniform grid of points on a 2-D surface, then performing the thermoforming operation to determine the distortions caused by the thermoforming technique. The distortion of the uniform grid can then be used to develop the coordinate mappings between 2-D and 3-D. Instead of using a uniform grid, the actual FSS can be thermoformed to predetermine the distortions. Another method uses projections that change with surface inflection, as concave areas will cause the elements to be drawn into a stretched condition. In such a case, the elements will be scaled down prior to forming. Conversely, areas of convex curvature may have elements scaled up so that upon forming they compress into a predetermined scale.

A flat FSS panel is constructed using the element positions determined from the mathematical mapping between 2-D and 3-D. In one embodiment, one or more flat FSS panels are constructed on a formable or thermo-formable substrate. In one embodiment, the substrate includes a thermoplastic. In one embodiment, the substrate includes a thermoplastic material with fiber reinforcement (e.g., fiberglass fibers, Kevlar fibers, etc.). In one embodiment, the FSS elements are created by printing. In one embodiment, the FSS elements are created by deposition. In one embodiment, the FSS elements are created by plating/depositing metal, then photo-etching. In one embodiment, the FSS elements include resonant elements. In one embodiment, the FSS elements include extended elements (e.g., long wires, long slots, meanderlines, etc.). In one embodiment, FSS elements are provided to one side of the substrate material. In one embodiment, FSS elements are provided to both sides of the substrate material. In one embodiment, multiple substrate and FSS layers are produced and bonded or otherwise combined to form a flat multilayer FSS structure. FIG. 2 shows an example of a flat FSS layer.

In one embodiment, one or more flat FSS layers are formed into a desired shape. In one embodiment, the flat FSS layers are thermoformed over a tool having the desired shape. In one embodiment, the FSS layers are formed to the shape of the tool by using vacuum techniques. In one embodiment, the FSS layers are formed to the shape of the tool by supporting the FSS layer between male and female tools. In one embodiment, the FSS layer is heated and thermoformed such that when removed from the tool, the FSS layer substantially retains the shape of the tool (or tools). In one embodiment, the FSS layer is chemically treated while pressed against the tool such that when removed from the tool, the FSS layer substantially retains the shape of the tool (or tools).

In one embodiment, a plurality of tools are used to produce curved FSS panels that can be assembled into a structure.

DETAILED DESCRIPTION

Figure 1:
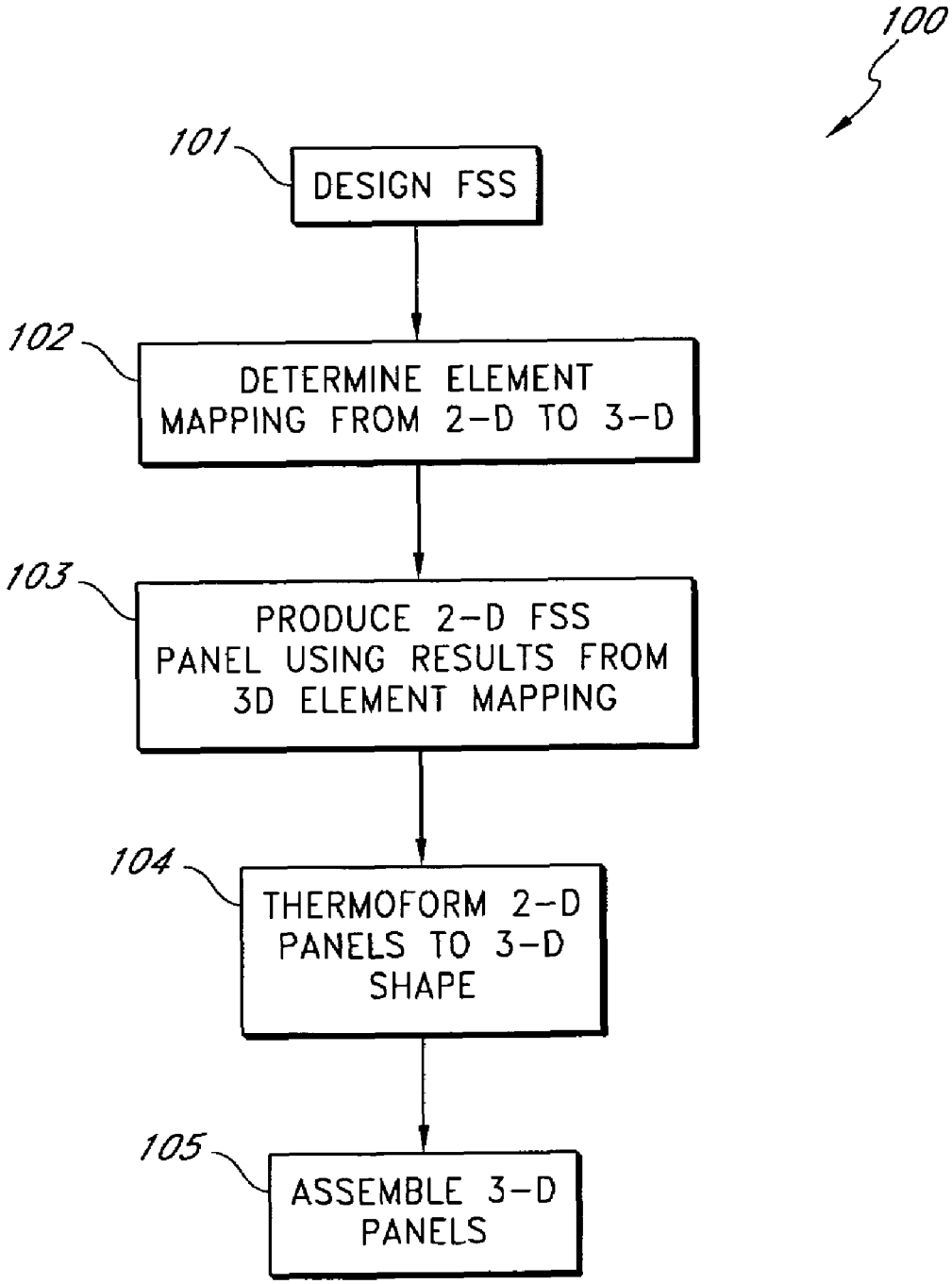
FIG. 1 is a flowchart showing the 3-D FSS fabrication process.

FIG. 1 is a flowchart showing a 3-D FSS design and fabrication process 100. In a first process block 101, a FSS structure is designed. Typically, the design programs and techniques used in the process block 101 assume the FSS is flat or that the radius of curvature of the FSS is relatively large with respect to the wavelength of a desired operational band of the FSS. The resulting design for a typical radome or other FSS structure includes the number of layers, the dielectric constant of the materials used in and around the FSS layers, the shape of the FSS elements in each layer and the spacing between FSS elements in each layer. Although not required, it is typical that the FSS elements are uniformly spaced on each FSS layer. Even when uniform spacing is not used, the spacing between elements affects the operational properties of the FSS and it is generally desirable to be able to control the element spacing during construction of the FSS layers. If the final FSS layers are to be flat or curved in one dimension, then it is relatively simple to construct flat FSS layers and roll the layers into a curved shape while maintaining FSS element shape, orientation, and spacing, as desired.

Curving a relatively thin FSS layer in a single dimension does not appreciably change the spacing between elements in the FSS layer because a relatively thin flat sheet can be curved in one dimension without stretching. However, a flat sheet cannot be curved in two dimensions without stretching or compressing. If the FSS layers are to be fully three-dimensional (i.e., curved in two dimensions), then the stretching or compression that occurs in forming a flat FSS layer into a two-dimensional curved surface will change the element spacing. Thus, in a process block 102, the 2-D flat surface of the designed FSS is mapped (mathematically and/or by physical testing) into a desired three-dimensional shape. The mapping from 2-D to 3-D is performed using the elastic properties of a desired substrate material and the physics involved with the preferred thermoforming technique (or through testing/experimentation on a uniform grid or the actual FSS). Once the mapping from 2-D to 3-D is determined, the desired element locations, orientations, and shapes on the 3-D FSS are inversely mapped from the 3-D space back to the flat 2-D space. The 3-D to 2-D mapping is used to re-map the element locations on the flat FSS panel such that when a 2-D panel is made using the element positions determined in the process block 102 and then elastically formed into the desired 3-D shape, the FSS elements on the 3-D shape will move to their proper positions during the forming process. In addition, the stretching and/or compression caused by warping the substrate from 2-D to 3-D may cause some elements to rotate as well as translate. Thus, in one embodiment, the coordinate mapping used in the process block 102 is used to determine the position and rotational orientation of one or more FSS elements on the flat FSS layer.

In one embodiment, the mapping between the 2-D flat FSS and the 3-D curved FSS is used to predict performance of the 3-D FSS and to allow an assessment of the performance of the 3-D panel. Thus, in one embodiment, an FSS is designed as a flat 2-D panel. Then the mapping between the 2-D panel and the 3-D panel is determined. The FSS is then re-analyzed using the resulting element orientation, shape, and/or spacing in the 3-D FSS to verify that the mapping from 2-D to 3-D does not adversely affect the desired performance. If the performance is adversely affected, then the mapping between the 3-D surface and the 2-D surface can be computed to re-map the position and/or orientation of the elements to be manufactured on the 2-D surface such that when the 2-D surface is formed into the desired 3-D shape, the 3-D FSS will have the element position and orientation (and element shape) to produce the desired electromagnetic performance.

In areas where the 3-D radius of curvature is relatively large, the mapping from 2-D to 3-D will produce a relatively smaller change in the element spacing. If the FSS design requires relatively tight control on element spacing (or orientation) such relatively smaller change may require re-mapping of the element spacing on the 2-D FSS. By contrast, if the particular FSS design does not require relatively tight control over element spacing (or orientation), then such relatively smaller change may not require re-mapping of the element spacing (or orientation) on the 2-D FSS panel. One of ordinary skill in the art will recognize that in mapping from the 2-D panel to a 3-D surface, different portions of the FSS can undergo different amounts of stretching and/or compression depending on the curvature in various regions of the 3-D surface. In areas where the 3-D radius of curvature is relatively smaller, the change in element spacing and/or orientation will be relatively larger, thus, increasing the likelihood that the location and/or orientation of the FSS elements on the 2-D panel will need to be re-mapped in order to produce a desired electromagnetic performance in the 3-D FSS. Thus, for some FSS designs, in order to achieve a desired electromagnetic performance in the 3-D panel, it is desirable to re-map the element spacing and/or orientation on some portions of the 2-D panel, while other portions of the 2-D panel can remain unchanged.

In addition to the 3D surfaces having continuous curvature implied above, this technique can also be applied to radomes having the shape commonly referred to as "chined." (for example, the F-22). In this case, the FSS would be formed in two parts, and bonded at the "chine line".

Design and construction of the FSS tends to be simpler and cheaper when working in the 2-D space. The mapping from two to three dimensions simplifies the process of designing and subsequent manufacture. For example, when using photo-etching processes to produce the FSS elements, the photo artwork can be developed in flat form and the elements can be photo-etched on flat panels of thermoplastic sheet stock (such as, for example, polyetherimide) using conventional etching equipment. In one embodiment, a conductive material (such as, for example, copper) is provided to the substrate by conductive bonding, electro-less plating, etc. In this manner, a desired 3-D part, with complex curvatures, can be designed and manufactured using 2-D techniques and yet when formed into a 3-D structure, the FSS elements will be properly positioned and oriented to provide the desired electromagnetic performance.

Figure 2A:
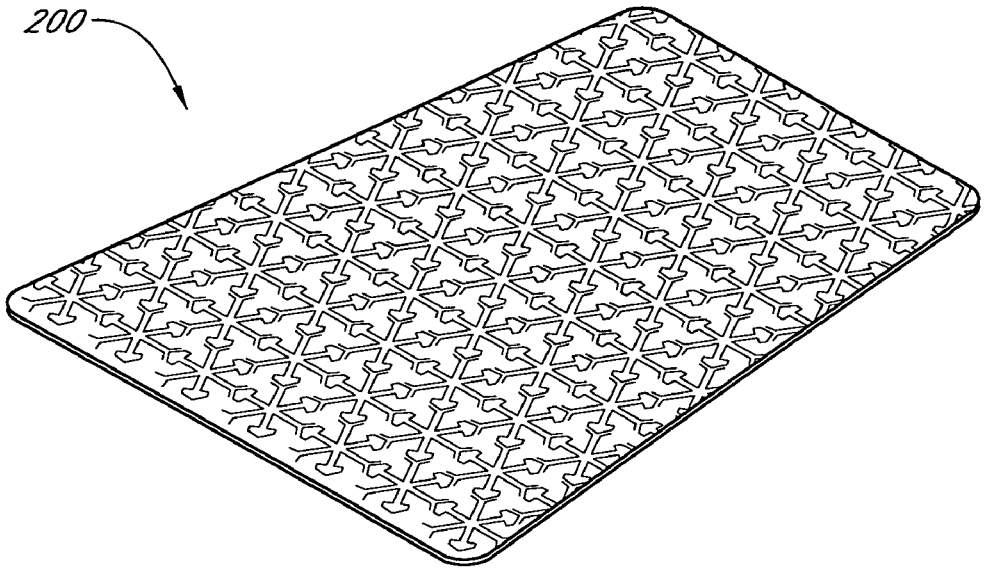
FIGS. 2A and 2B shows a 2-D FSS panel ready for thermoforming.
Figure 2B:
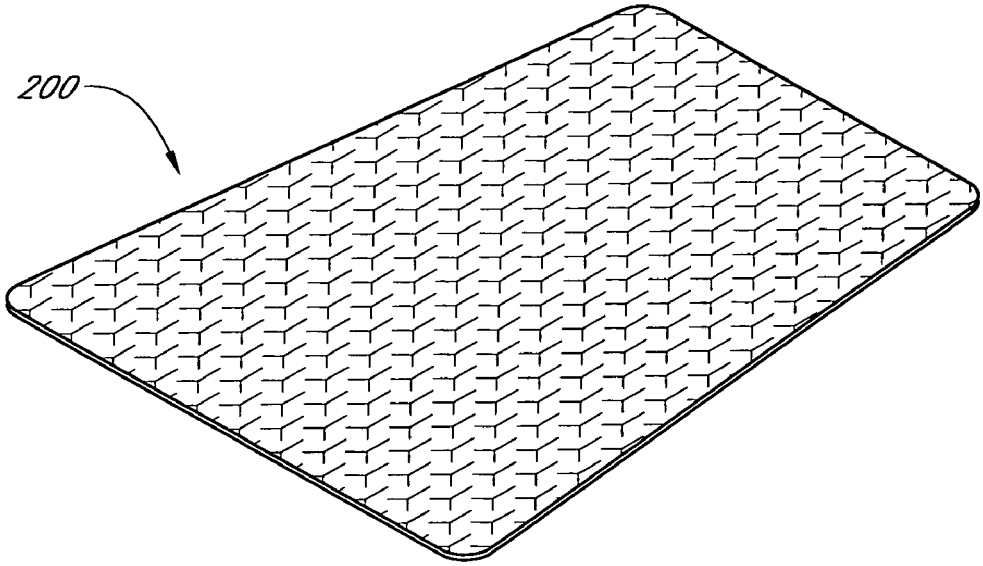

In a process block 103, a flat FSS panel is constructed using the element positions determined in the process block 102. In one embodiment, the flat FSS panels is constructed on a formable or thermo-formable substrate material such as, for example, plastic, thermoplastic, etc. The FSS elements can be created by printing, etching, deposition, etc. The FSS elements can be any type of FSS elements including, but not limited to, wire-type elements, slot-type elements, patch-type elements, etc. The FSS elements can be discrete resonant elements and/or extended elements (e.g., long wires, long slots, meanderlines, etc.). In one embodiment, FSS elements are provided to one side of a substrate material. In one embodiment, FSS elements are provided to both sides of a substrate material. In one embodiment, multiple substrate and FSS layers are produced and bonded or otherwise combined to form a flat multi-layer FSS structure. FIG. 2 shows an example of a flat FSS layer.

Figure 3:
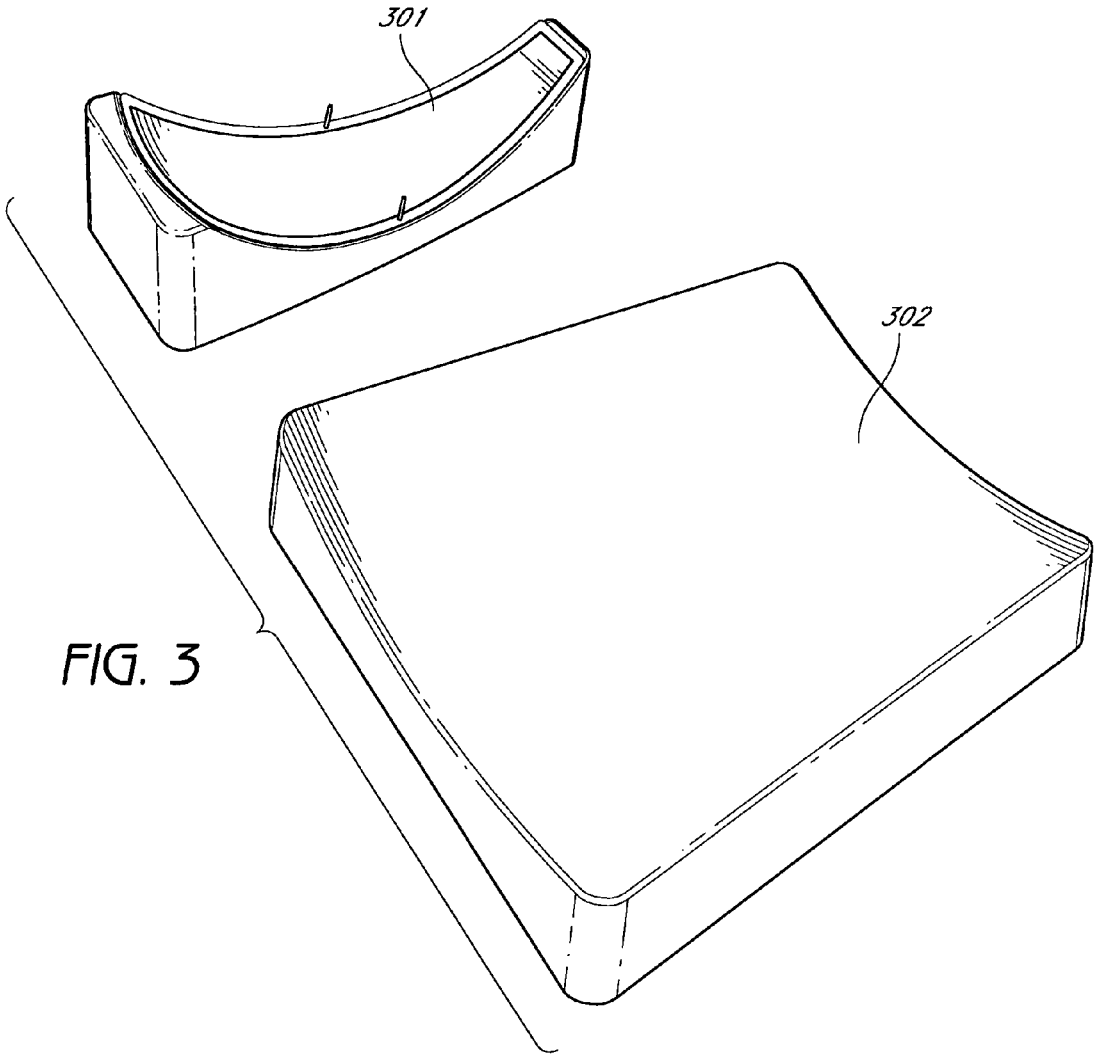
FIG. 3 shows tooling used for thermoforming the 2-D panels into 3-D panels.

The flat FSS layer (or structure) formed in the process block 103 is then formed into a desired shape in a process block 104. In one embodiment, the flat FSS layer or structure is thermoformed over a tool having the desired shape. FIG. 2 shows an example of a flat FSS layer 200 ready for forming. FIG. 3 shows a first example of a tool 301 and a second example of a tool 302 for forming 3-D curved FSS layers. In one embodiment, the FSS layers are formed to the shape of the tool by using vacuum bagging techniques. In one embodiment, the FSS layers are formed to the shape of the tool by using male and female tools and the FSS layer is pressed between the male and female tools. In one embodiment, the FSS layer is heated and thermoformed such that when removed from the tool, the FSS layer substantially retains the shape of the tool. In one embodiment, the FSS layer is chemically treated while pressed against the tool such that when removed from the tool, the FSS layer substantially retains the shape of the tool.

Figure 4:
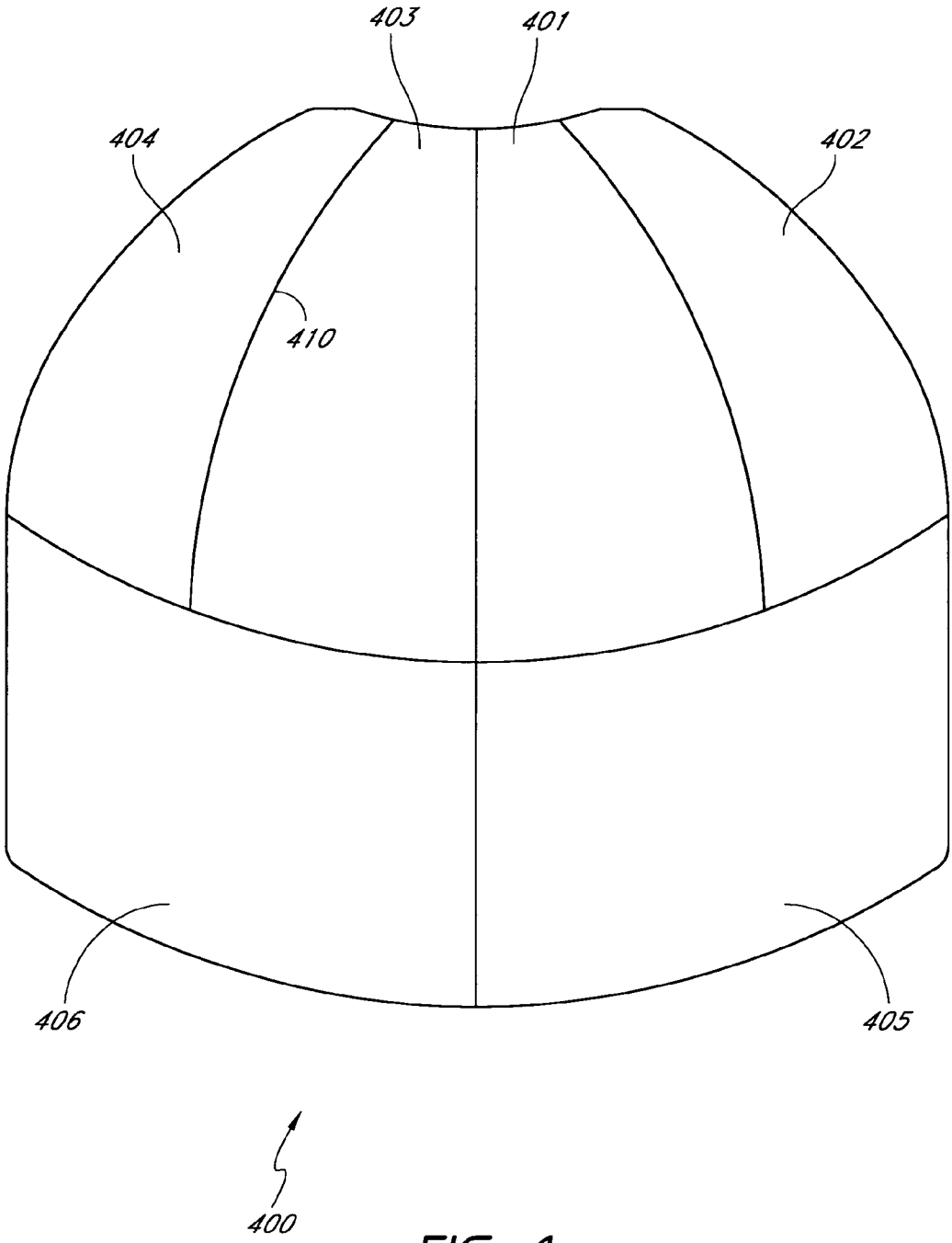
FIG. 4 shows a radome assembled from the 3-D panels.

In an optional process block 105, two or more 3-D curved FSS layers produced according to the process of process blocks 101-104 are combined, along with other dielectric layers as desired, to form a radome or other desired structure, as shown in FIG. 4. FIG. 4 shows an example of a structure 400 wherein 3-D FSS panels 401-404 are formed according to a first 3-D curvature using a first tool and FSS panels 405-406 are formed according to a second 3-D curvature using a second tool. The panels 403 and 404 share a common seam 410. One of ordinary skill in the art will recognize that other shapes can be produced using the process 100. Different FSS layers formed according to the process 100 can be combined with foam, honeycomb, or other spacer layers to form multi-layer FSS structures.

The forming of FSS panels, as described herein, allows the element pattern as seams, such as, for example, the seam 410 shown in FIG. 4, to be constructed such that the element grid pattern is relatively uninterrupted at a seam. As described herein, the element geometry and grid pattern can be predistorted on the two-dimensional flat panel FSS layers such as that when formed into three-dimensional panels and combined into a desired object, the element grids line up at the three-dimensional seams. Keeping the element grid substantially interrupted at the seams typically improves the electrical performance of the final FSS structure.

Although described in terms of specific embodiments, other embodiments will be readily apparent to one of ordinary skill in the art from the above disclosure. For example, although the term substrate is used herein, one of ordinary skill in the art will recognize that the FSS (or FSS layers) can be provided to a substrate, a superstrate, or combinations of substrates and superstrates, etc. Thus, the invention herein is not limited to the disclosed embodiments, but rather by the claims that follow.

What is claimed is:

1. A method for constructing a three-dimensional FSS structure, comprising:

designing an FSS having a desired spacing between FSS elements;

determining a mapping from a two-dimensional surface to a three-dimensional shape according to an elastic property of a substrate material and a shape of a tool that describes said desired three-dimensional shape;

determining a desired position for each of said FSS elements according to said mapping;

creating a plurality of physical FSS elements to a substantially flat substrate, each of said physical FSS elements positioned according to said mapping; and forming said substrate to said three-dimensional shape.

2. The method of claim 1, wherein said substrate comprises a thermoplastic.

3. The method of claim 1, wherein said substrate comprises a thermoplastic with support fibers.

4. The method of claim 1, wherein said forming comprises thermoforming.

5. The method of claim 1, wherein said forming comprises thermoforming using vacuum to force said FSS layer against said tool.

6. The method of claim 1, wherein said forming comprises thermoforming using first and second tools to mold a shape of said FSS layer.

7. The method of claim 1, wherein said FSS elements comprise slot-type elements.

8. The method of claim 1, wherein said FSS elements comprise wire-type elements.

9. The method of claim 1, wherein said FSS elements comprise patch-type elements.

10. The method of claim 1, wherein said FSS elements comprise resonant-type elements.

11. The method of claim 1, wherein said FSS elements comprise nonresonant-type elements.

12. The method of claim 1, further comprising combining one or more three-dimensional FSS structures.

13. The method of claim 1, wherein said determining a mapping comprises physical testing.

14. An FSS structure constructed by:

determining a desired element shape of FSS elements and a desired spacing between said FSS elements;

determining a mapping from a two-dimensional surface to a desired three-dimensional shape according to at least an elastic property of a substrate material and said desired three-dimensional shape;

creating a plurality of physical FSS elements on a substantially flat substrate, each of said physical FSS elements shaped according to said desired element shape and positioned according to said mapping; and forming said substrate to said three-dimensional shape by pressing said substrate against a tool that corresponds to said desired three-dimensional shape.

15. The FSS structure of claim 14, wherein said FSS elements are provided to an upper surface of said substrate and to a lower surface of said substrate.

16. The FSS structure of claim 14, wherein said forming comprises thermoforming.

17. The FSS structure of claim 14, wherein said forming comprises thermoforming using vacuum to force said substrate against said tool.

18. The FSS structure of claim 14, wherein said forming comprises thermoforming using first and second tools to mold a shape of said FSS layer.

19. The FSS structure of claim 14, wherein said FSS elements comprise slot-type elements.

20. The FSS structure of claim 14, wherein said FSS elements comprise wire-type elements.

21. The FSS structure of claim 14, wherein said FSS elements comprise patch-type elements.

22. The FSS structure of claim 14, wherein said FSS elements comprise resonant-type elements.

23. The FSS structure of claim 14, wherein said FSS elements comprise nonresonant-type elements.

24. The FSS structure of claim 14, wherein said substrate comprises a thermoplastic.

25. The FSS structure of claim 14, wherein said substrate comprises a thermoplastic with support fibers.

26. The FSS structure of claim 14, further comprising calculating an electromagnetic performance of said FSS according to said mapping.

27. The FSS structure of claim 14, wherein said mapping from a two-dimensional surface to a desired three-dimensional shape is determined by physical testing.

28. The FSS structure of claim 14, wherein said mapping from a two-dimensional surface to a desired three-dimensional shape is determined by physical testing of an FSS provided to a substrate.

29. The FSS structure of claim 14, wherein said mapping from a two-dimensional surface to a desired three-dimensional shape is determined by physical testing of an FSS provided to a thermoplastic material.

30. The FSS structure of claim 14, wherein said mapping from a two-dimensional surface to a desired three-dimensional shape is determined by deforming a flat FSS in the desired three-dimensional shape and measuring the effect of said deforming on elements of said FSS.

* * * * *

UNITED STATES PATENT AND TRADEMARK OFFICE

CERTIFICATE OF CORRECTION

PATENT NO. : 7,414,593 B2
APPLICATION NO. : 11/362442
DATED : August 19, 2008
INVENTOR(S) : Williams et al.

It is certified that error appears in the above-identified patent and that said Letters Patent is hereby corrected as shown below:

In column 5 at line 38, change “pattern as” to --pattern at--.

In column 5 at line 42, after “such” delete “as”.

In column 5 at line 46, change “interrupted” to --uninterrupted--.

Signed and Sealed this

Fourteenth Day of July, 2009

John Doll

JOHN DOLL
*Acting Director of the United States Patent and Trademark Office*